US009865231B2

(12) United States Patent
Kim et al.

(10) Patent No.: US 9,865,231 B2
(45) Date of Patent: Jan. 9, 2018

(54) ADAPTIVE IMAGE COMPENSATION METHODS AND RELATED APPARATUSES

(71) Applicant: Samsung Electronics Co., Ltd., Suwon-si, Gyeonggi-do (KR)

(72) Inventors: Bo Young Kim, Hwaseong-si (KR); Kyoung Man Kim, Suwon-si (KR)

(73) Assignee: Samsung Electronincs Co., Ltd. (KR)

( * ) Notice: Subject to any disclaimer, the term of this patent is extended or adjusted under 35 U.S.C. 154(b) by 395 days.

(21) Appl. No.: 14/540,629

(22) Filed: Nov. 13, 2014

(65) Prior Publication Data

US 2015/0130823 A1 May 14, 2015

(30) Foreign Application Priority Data

Nov. 13, 2013 (KR) ..... 10-2013-0137942

(51) Int. Cl.

| | |
|---|---|
| ***G09G 5/18*** | (2006.01) |
| ***G09G 3/3225*** | (2016.01) |
| ***G09G 3/20*** | (2006.01) |
| ***G09G 5/36*** | (2006.01) |

(52) U.S. Cl.

CPC ..... *G09G 5/18* (2013.01); *G09G 3/20* (2013.01); *G09G 3/3225* (2013.01); *G09G 5/36* (2013.01); *G09G 2320/0673* (2013.01); *G09G 2330/021* (2013.01); *G09G 2340/0435* (2013.01); *G09G 2340/06* (2013.01); *G09G 2360/145* (2013.01); *G09G 2360/16* (2013.01)

(58) Field of Classification Search

CPC ..... G09G 5/18; G09G 2320/0673; G09G 2340/0435; G09G 2340/06; G09G 2360/145; G09G 2360/16

See application file for complete search history.

(56) References Cited

U.S. PATENT DOCUMENTS

| | | | | |
|---|---|---|---|---|
| 6,738,054 | B1 | 5/2004 | Yamaguchi | |
| 7,463,295 | B2 | 12/2008 | Asada et al. | |
| 2008/0097203 | A1* | 4/2008 | Nereson | G01S 7/52053 600/437 |
| 2010/0053222 | A1* | 3/2010 | Kerofsky | G09G 3/3406 345/690 |
| 2012/0256735 | A1* | 10/2012 | Gilson | G08C 23/04 340/12.17 |

(Continued)

FOREIGN PATENT DOCUMENTS

| | | |
|---|---|---|
| JP | 2001-169143 | 6/2001 |
| JP | 2006-319953 | 11/2006 |

(Continued)

*Primary Examiner* — Jacinta M Crawford

(74) *Attorney, Agent, or Firm* — Myers Bigel, P.A.

(57) ABSTRACT

Methods of adaptive image compensation are provided. A method of adaptive image compensation includes receiving illumination information sensed by a light sensor. The method includes calculating image characteristic information by analyzing an input image. The method includes determining a frame rate responsive to at least one among the illumination information, the image characteristic information, and a frame rate control signal. Moreover, the method includes compensating the input image responsive to the frame rate. Related apparatuses and image processing systems are also provided.

19 Claims, 13 Drawing Sheets

(56) References Cited

U.S. PATENT DOCUMENTS

| | | | | |
|---|---|---|---|---|
| 2013/0077887 | A1* | 3/2013 | Elton | G06T 3/4053 382/264 |
| 2013/0335309 | A1* | 12/2013 | Kerofsky | G09G 3/3406 345/102 |
| 2014/0306969 | A1* | 10/2014 | Tang | G09G 5/006 345/520 |

FOREIGN PATENT DOCUMENTS

| | | | |
|---|---|---|---|
| JP | 2010-257100 | | 11/2010 |
| KR | 1020020086480 | A | 11/2002 |
| KR | 1020030003065 | A | 1/2003 |
| KR | 1020030047730 | A | 6/2003 |
| KR | 1020060008644 | A | 1/2006 |
| KR | 1020100035028 | A | 4/2010 |
| KR | 1020100083933 | A | 7/2010 |
| KR | 1020120005127 | A | 1/2012 |

* cited by examiner

ADAPTIVE IMAGE COMPENSATION METHODS AND RELATED APPARATUSES

CROSS-REFERENCE TO RELATED APPLICATION

This application claims priority under 35 U.S.C. §119(a) from Korean Patent Application No. 10-2013-0137942, filed on Nov. 13, 2013, the disclosure of which is hereby incorporated herein by reference in its entirety.

BACKGROUND

The present disclosure relates to image compensation. Display devices may display images at a rate of 60 frames per second (fps). There have been attempts to decrease frame rates below 60 fps, however, to reduce power consumption of display devices or systems (e.g., mobile terminals) including a display device. But when the frame rate of display devices is decreased, picture quality may be degraded.

SUMMARY

Various embodiments of present inventive concepts provide a method of adaptively compensating an input image to be displayed on a display device. The method may include receiving illumination information sensed by a light sensor. The method may include calculating image characteristic information by analyzing the input image. The method may include determining a frame rate according to at least one among the illumination information, the image characteristic information, and a frame rate control signal. Moreover, the method may include compensating the input image responsive to the frame rate.

In various embodiments, the method may further include outputting a compensated image according to the frame rate. In some embodiments, determining the frame rate may include comparing the illumination information with an illumination threshold, comparing the image characteristic information with a characteristic threshold, and holding or changing the frame rate, responsive to a first result of comparing the illumination information with the illumination threshold and/or responsive to a second result of comparing the image characteristic information with the characteristic threshold.

According to various embodiments, compensating the input image may include determining a compensation level for the input image according to the frame rate, and applying the compensation level to each of a plurality of pixel signals of the input image. In some embodiments, each of the pixel signals may include at least one of a luminance signal and a chroma signal.

In various embodiments, determining the compensation level may include selecting a gamma table corresponding to the frame rate from among a plurality of gamma tables that are set in advance according to different frame rates. Each of the plurality of gamma tables may include a plurality of input signal level value-to-output signal level value entries. Each of a plurality of input signal level values may include a luminance signal of the input image or a chroma signal of the input image. Moreover, each of a plurality of output signal level values may include a luminance signal of the compensated image or a chroma signal of the compensated image.

According to various embodiments, compensating the input image may include converting the input image from an RGB format into a YPbPr or YCbCr format, compensating the input image after converting the input image from the RGB format into the YPbPr or YCbCr format, and converting the input image back into the RGB format after compensating the input image. In some embodiments, compensating the input image may include one of: compensating all of the plurality of pixel signals of the input image; and selectively compensating only ones of the plurality of pixel signals of the input image that are in a particular range.

In various embodiments, the method may include selectively enabling the light sensor. Moreover, in some embodiments, the frame rate control signal may include a signal that selectively changes the frame rate according to a predetermined scenario or a type of the input image.

An adaptive image compensation apparatus, according to various embodiments, may include an image analysis logic configured to analyze an input image and calculate image characteristic information. The apparatus may include a frame rate control logic configured to determine a frame rate according to at least one of illumination information and the image characteristic information. Moreover, the apparatus may include an image compensation logic configured to compensate the input image responsive to the frame rate.

In various embodiments, the frame rate control logic may be configured to determine whether to change the frame rate according to the illumination information and the image characteristic information. In some embodiments, the frame rate control logic may be configured to compare the illumination information with an illumination threshold, compare the image characteristic information with a characteristic threshold, and hold or change the frame rate, responsive to a first result of comparing the illumination information with the illumination threshold and/or responsive to a second result of comparing the image characteristic information with the characteristic threshold.

According to various embodiments, the image compensation logic may be configured to determine a compensation level for the input image according to the frame rate, and to apply the compensation level to each of a plurality of pixel signals of the input image. In some embodiments, the image compensation logic may be configured to determine a compensation level for the input image according to the frame rate, and the compensation level may be uniform for every pixel signal in a frame or may vary depending on a level of each of a plurality of pixel signals in the frame.

In various embodiments, the adaptive image compensation apparatus may include a memory configured to store a plurality of gamma tables that are predetermined according to different frame rates. The image compensation logic may be configured to select a gamma table corresponding to the frame rate from among the plurality of gamma tables, and may be configured to apply the gamma table to the input image. Moreover, each of the plurality of gamma tables may include a plurality of input signal level value-to-output signal level value entries.

According to various embodiments, the image compensation logic may be configured to convert the input image from an RGB format into a YPbPr or YCbCr format, to compensate the input image after converting the input image from the RGB format into the YPbPr or YCbCr format, and to convert the input image back into the RGB format after compensating the input image.

An image processing system, according to various embodiments, may include a display device and a light sensor configured to sense illumination information. Moreover, the system may include a system-on-chip (SoC) configured to change a frame rate responsive to a type of image to be displayed on the display device, to adaptively compensate the image responsive to a change of the frame rate and the illumination information, and to output a compensated image to the display device.

In various embodiments, the SoC may include a central processing unit (CPU) configured to output a frame rate control signal that changes the frame rate according to the type of image. The SoC may include an image analysis logic configured to calculate a histogram of the image and to calculate image characteristic information from the histogram. The SoC may include a frame rate control logic configured to determine whether to change the frame rate according to the illumination information and the image characteristic information. Moreover, the SoC may include an image compensation logic configured to compensate the image according to the change of the frame rate.

According to various embodiments, the frame rate control logic may be configured to hold the frame rate when both the illumination information and the image characteristic information are in a particular range. Moreover, the frame rate control logic may be configured to change the frame rate according to the frame rate control signal when either of the illumination information and the image characteristic information is outside of the particular range.

In various embodiments, the image compensation logic may be configured to select a compensation level table corresponding to the frame rate from among a plurality of compensation level tables. Moreover, the image compensation logic may be configured to compensate the image using the compensation level table.

A method of operating an image processing apparatus, according to various embodiments, may include analyzing an image that is input to the image processing apparatus. The method may include determining a change of a frame rate for displaying images, responsive to analyzing the image. Moreover, the method may include determining, based on the frame rate or the change of the frame rate, a quality compensation level for the image that is input to the image processing apparatus, after determining the change of the frame rate.

In various embodiments, determining the change of the frame rate may include changing the frame rate responsive to an image type of the image that is input to the image processing apparatus. Moreover, determining the quality compensation level for the image may include compensating the image to the quality compensation level, responsive to determining the change of the frame rate.

According to various embodiments, changing the frame rate responsive to the image type may include changing the frame rate responsive to determining that the image type of the image that is input to the image processing apparatus includes a still image. Moreover, the change of the frame rate may include a decrease of the frame rate, and compensating the image may include compensating the image to the quality compensation level, responsive to the decrease of the frame rate.

In various embodiments, analyzing the image may include calculating image characteristic information for the image. Moreover, the method may include receiving illumination information from a light sensor. The method may include holding the frame rate constant instead of performing the change of the frame rate, responsive to determining that the illumination information does not exceed an illumination threshold and/or that the image characteristic information does not exceed a characteristic threshold. In some embodiments, holding the frame rate constant may include holding the frame rate constant despite receiving a signal to change the frame rate.

BRIEF DESCRIPTION OF THE DRAWINGS

Example embodiments will be more clearly understood from the following brief description taken in conjunction with the accompanying drawings. The accompanying drawings represent non-limiting, example embodiments as described herein.

DETAILED DESCRIPTION

Figure 1:
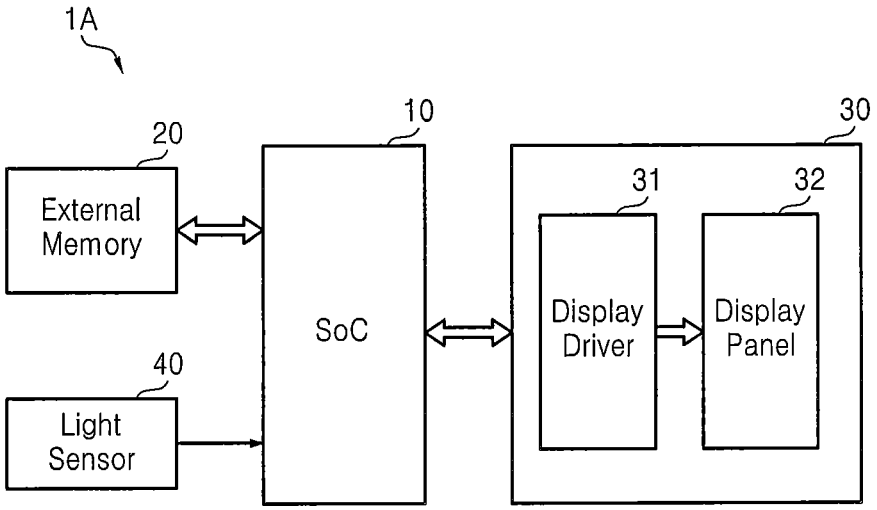
FIG. 1 is a schematic block diagram of an image processing system according to various embodiments of present inventive concepts.

Example embodiments are described below with reference to the accompanying drawings. Many different forms and embodiments are possible without deviating from the spirit and teachings of this disclosure and so the disclosure should not be construed as limited to the example embodiments set forth herein. Rather, these example embodiments are provided so that this disclosure will be thorough and complete, and will convey the scope of the disclosure to those skilled in the art. In the drawings, the sizes and relative sizes of layers and regions may be exaggerated for clarity. Like reference numbers refer to like elements throughout the description.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of the stated features, steps, operations, elements, and/or components, but do not preclude the presence or addition of one or more other features, steps, operations, elements, components, and/or groups thereof.

It will be understood that when an element is referred to as being "coupled," "connected," or "responsive" to, or "on," another element, it can be directly coupled, connected, or responsive to, or on, the other element, or intervening elements may also be present. In contrast, when an element is referred to as being "directly coupled," "directly connected," or "directly responsive" to, or "directly on," another element, there are no intervening elements present. As used herein the term "and/or" includes any and all combinations of one or more of the associated listed items.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein may be interpreted accordingly.

Example embodiments of present inventive concepts are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments of present inventive concepts should not be construed as limited to the particular shapes of regions illustrated herein but are to include deviations in shapes that result, for example, from manufacturing. Accordingly, the regions illustrated in the figures are schematic in nature and their shapes are not intended to illustrate the actual shape of a region of a device and are not intended to limit the scope of example embodiments.

FIG. 1 is a schematic block diagram of an image processing system 1A according to various embodiments of present inventive concepts. The image processing system 1A includes a system-on-chip (SoC) 10, an external memory 20, a display device 30, and a light sensor 40. Each of the elements 10, 20, 30, and 40 may be implemented in an individual chip. In some embodiments, the image processing system 1A may also include other elements (e.g., a camera interface). The image processing system 1A may be a mobile device, a handheld device, or a handheld computer, such as a mobile phone, a smart phone, a table personal computer (PC) (or another tablet computer), a personal digital assistant (PDA), a portable multimedia player (PMP), an MP3 player, or an automotive navigation system, that can display image or video signals on the display device 30.

The external memory 20 stores program instructions executed in the SoC 10. The external memory 20 may store image data used to display a still image on the display device 30. The external memory 20 may also store image data used to display a moving image. The moving image may be a series of different still images presented for a short time.

The external memory 20 may be a volatile or non-volatile memory. The volatile memory may be dynamic random access memory (DRAM), static RAM (SRAM), thyristor RAM (T-RAM), zero capacitor RAM (Z-RAM), or twin transistor RAM (TTRAM). The non-volatile memory may be electrically erasable programmable read-only memory (EEPROM), flash memory, magnetic RAM (MRAM), phase-change RAM (PRAM), or resistive memory.

The SoC 10 controls the external memory 20 and/or the display device 30. The SoC 10 may be referred to as an integrated circuit (IC), a processor, an application processor, a multimedia processor, or an integrated multimedia processor.

The display device 30 includes a display driver 31 and a display panel 32. According to some embodiments, the SoC 10 and the display driver 31 may be integrated into a single module, a single SoC, or a single package, e.g., a multi-chip package. According to some embodiments, the display driver 31 and the display panel 32 may integrated into a single module.

The display driver 31 controls the operation of the display panel 32 according to signals output from the SoC 10. For instance, the display driver 31 may transmit, as an output image signal, image data from the SoC 10 to the display panel 32 via a selected interface.

The display panel 32 may display the output image signal received from the display driver 31. The display panel 32 may be implemented as a liquid crystal display (LCD) panel, a light emitting diode (LED) display panel, an organic LED (OLED) display panel, or an active-matrix OLED (AMOLED) display panel.

The light sensor 40 detects illumination, i.e., the intensity of light and provides illumination information to/for the SoC 10. The light sensor 40 may be enabled or disabled depending on whether the image processing system 1A is on or off, or may be enabled or disabled selectively or independently. For instance, the light sensor 40 may be selectively enabled only when an adaptive image compensation method is performed according to some embodiments of present inventive concepts, thereby reducing power consumption. Whether to perform the adaptive image compensation method according to some embodiments of present inventive concepts may be determined by setting a particular bit in a particular register.

Figure 2:
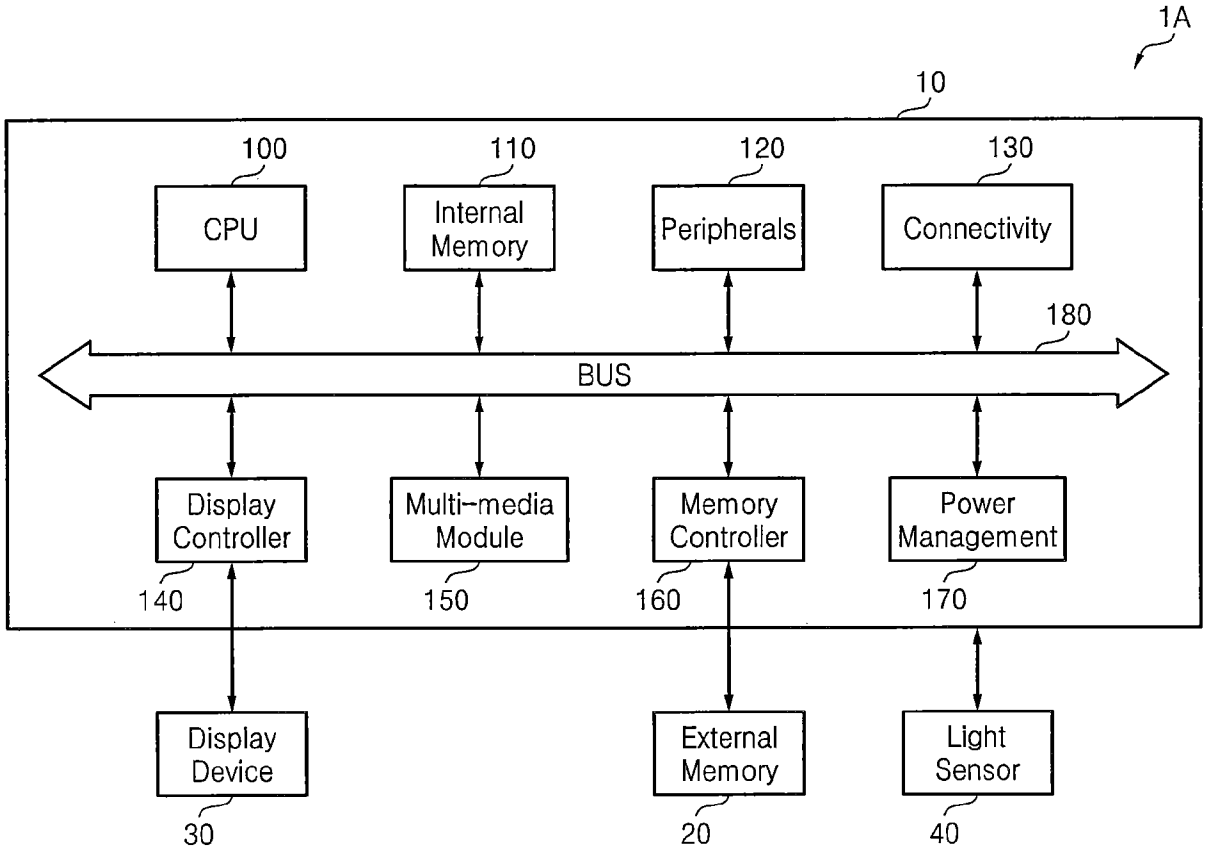
FIG. 2 is a detailed block diagram of a system-on-chip (SoC) illustrated in FIG. 1.

FIG. 2 is a detailed block diagram of the SoC 10 illustrated in FIG. 1. The SoC 10 may include a central processing unit (CPU) 100, an internal memory 110, peripherals 120 (e.g., digital peripherals), a connectivity circuit 130, a display controller 140, a multimedia module 150, a memory controller 160, a power management unit 170, and a bus 180.

The CPU 100, which may be referred to as a processor, may process or execute programs and/or data stored in the external memory 20. For instance, the CPU 100 may process or execute the programs and/or the data in response to an operating clock signal.

The CPU 100 may be implemented as a multi-core processor. The multi-core processor is a single computing component with two or more independent actual processors (referred to as cores). Each of the processors may read and execute program instructions.

The internal memory 110 stores programs and/or data. The internal memory 110 may be used as a buffer that temporarily stores programs and/or data stored in the external memory 20. The internal memory 110 may include ROM and RAM.

The ROM may store permanent programs and/or data. The ROM may be implemented as EPROM or EEPROM. The RAM may temporarily store programs, data, or instructions. The programs and/or data stored in the external memory 20 may be temporarily stored in the RAM according to the control of the CPU 100 or a booting code stored in the ROM. The RAM may be implemented as DRAM or SRAM.

The programs and/or the data stored in the internal memory 110 or the external memory 20 may be loaded to a memory in the CPU 100 when necessary.

The peripherals 120 may include circuits, such as a timer, a direct memory access (DMA) circuit, and an interrupt circuit, that are beneficial/necessary for operations of the image processing system 1A.

The connectivity circuit 130 may include circuits that provide an interface with an external device. For instance, the connectivity circuit 130 may include a universal asynchronous receiver/transmitter (UART), an integrated interchip sound (I2S) circuit, an inter-integrated circuit (I2C), and/or a universal serial bus (USB) circuit.

The display controller 140 controls operations of the display device 30. The display device 30 may display images or video signals output from the display controller 140. In some embodiments, the display controller 140 may access the memory 110 or 20 and output images to the display device 30 according to the control of the CPU 100.

The multimedia module 150 may process images or video signals or convert images or video signals into signals suitable to be output. For instance, the multimedia module 150 may perform compression, decompression, encoding, decoding, format conversion, and/or size conversion on images or video signals. The structure and operations of the multimedia module 150 are described in greater described herein.

The memory controller 160 interfaces with the external memory 20. The memory controller 160 controls overall operation of the external memory 20 and controls data communication between a host and the external memory 20. The memory controller 160 may write data to the external memory 20 or read data from the external memory 20 at the request of the host. The host may be a master device such as the CPU 100, the multimedia module 150, or the display controller 140.

The external memory 20 is a storage medium for storing data and may store an operating system (OS), various kinds of programs, and/or various kinds of data. Although the external memory 20 may be DRAM, present inventive concepts are not restricted thereto. For instance, the external memory 20 may be non-volatile memory such as flash memory, PRAM, magnetic RAM (MRAM), resistive RAM (RRAM), or ferroelectric RAM (FRAM), flash memory, an embedded multimedia card (eMMC), or a universal flash storage (UFS).

The elements 100, 110, 120, 130, 140, 150, 160, and 170 may communicate with one another through the bus 180. The bus 180 may be implemented as a multi-layer bus.

The SoC 10 may include other elements than the elements shown in FIG. 2. For instance, the SoC 10 may include a clock management unit that generates an operating clock signal and provides it for each element. The clock management unit may include a clock signal generator such as a phase locked loop (PLL), a delay locked loop (DLL), or a crystal oscillator.

Although FIG. 2 illustrates that the power management unit 170 is implemented within the SoC 10, it may alternatively be implemented outside the SoC 10 in some embodiments.

Figure 3:
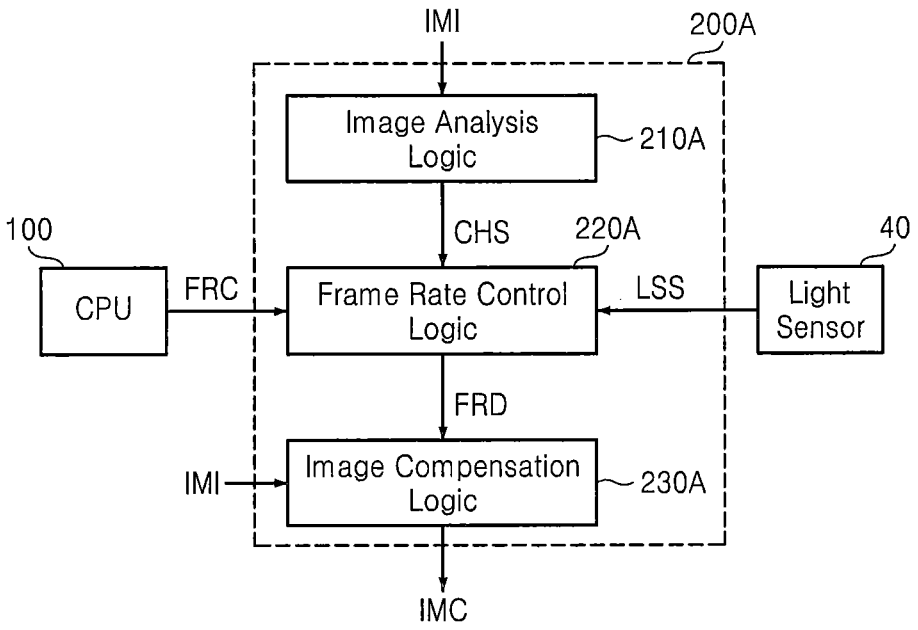
FIG. 3 is a structural block diagram of an image processing apparatus according to various embodiments of present inventive concepts.

FIG. 3 is a structural block diagram of an image processing apparatus 200A according to some embodiments of present inventive concepts. Referring to FIG. 3, the image processing apparatus 200A includes an image analysis logic 210A, a frame rate control logic 220A, and an image compensation logic 230A.

The image analysis logic 210A analyzes an input image IMI and calculates image characteristic information CHS. The input image IMI may be an image that has not yet been transmitted to the display device 30. The input image IMI may be received from the memory 20 or 110 or it may be a signal received from the multimedia module 150.

The image analysis logic 210A may calculate a histogram of the input image IMI and may calculate the image characteristic information CHS from the histogram. The histogram may be a luminance or chroma histogram but is not restricted thereto. The image characteristic information CHS may be at least one among an average luminance of the input image IMI, a variance of the luminance, an average chroma of the input image IMI, and a variance of the chroma, but is not restricted thereto.

The frame rate control logic 220A determines a frame rate according to illumination information LSS and the image characteristic information CHS. The illumination information LSS may be output from the light sensor 40. The frame rate control logic 220A may set a frame rate change range according to the illumination information LSS and the image characteristic information CHS.

Figure 4:
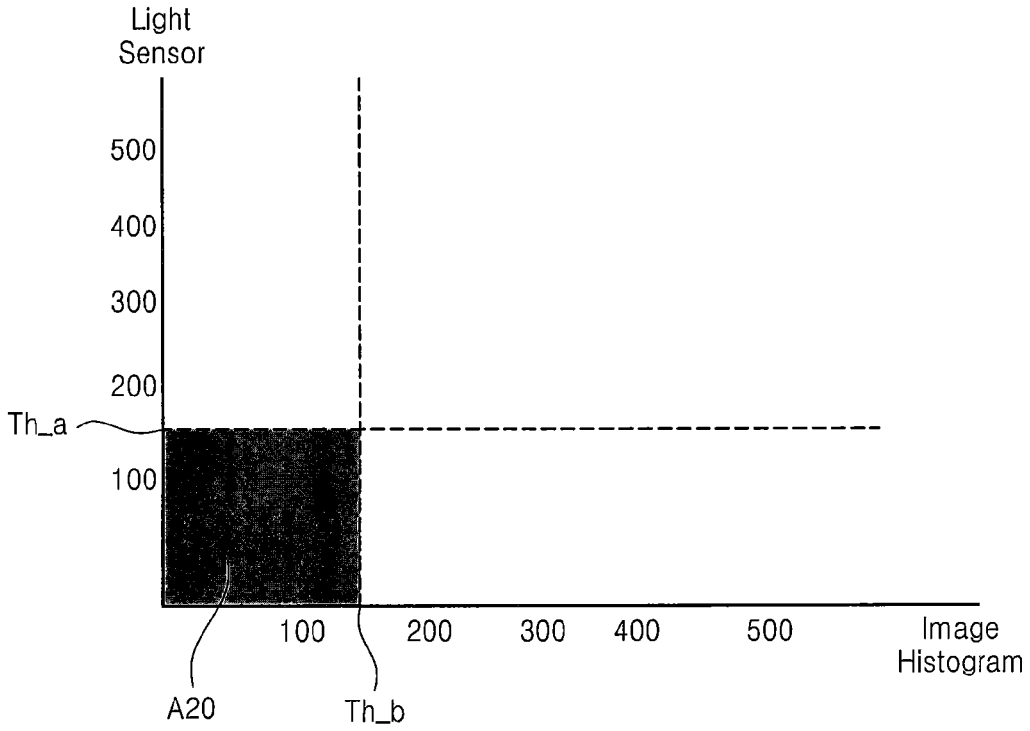
FIG. 4 is a graph showing a frame rate change range with respect to image characteristic information and illumination information according to various embodiments of present inventive concepts.

FIG. 4 is a graph showing a frame rate change range with respect to the image characteristic information CHS and the illumination information LSS according to some embodiments of present inventive concepts. Referring to FIG. 4, when the illumination information LSS is equal to or less than a predetermined illumination threshold Th_a and the image characteristic information CHS is equal to or less than a predetermined characteristic threshold Th_b in a case/example A20, the frame rate may be prohibited from being changed. On the other hand, when the illumination information LSS is greater than the illumination threshold Th_a or the image characteristic information CHS is greater than the characteristic threshold Th_b, the frame rate may be changed.

Referring again to FIG. 3, the frame rate control logic 220A may determine a final frame rate FRD according to a frame rate control signal FRC from the CPU 100. The CPU 100 may change a frame rate, using the frame rate control signal FRC, according to a predetermined scenario of the image processing system 1A or a type of data to be displayed. For instance, when data to be displayed on the display device 30 is a still image, the CPU 100 may decrease a frame rate to 48 or 40 frames per second (fps) to reduce the power consumption of the image processing system 1A. At this time, the CPU 100 may output the frame rate control signal FRC for changing the frame rate to the frame rate control logic 220A.

The frame rate control logic 220A may compare the illumination information LSS with the illumination threshold Th_a and the image characteristic information CHS with the characteristic threshold Th_b and may determine the final frame rate FRD according to the frame rate control signal FRC when the comparison result indicates a frame rate changeable range. For instance, the current frame rate may be changed into a frame rate (e.g., 48 or 40 fps) in accordance with the frame rate control signal FRC in the frame rate changeable range. However, in a frame rate unchangeable range, the frame rate control logic 220A may maintain the current frame rate without changing it, even when the frame rate control signal FRC instructs or indicates the change of the frame rate to 48 or 40 fps.

The frame rate control logic 220A determines a compensation level for the input image IMI according to (e.g., responsive to, based on, using) the final frame rate FRD and compensates the input image IMI according to the compensation level. The image compensation logic 230A may also determine the compensation level according to the illumination information LSS and the image characteristic information CHS.

For instance, the image compensation logic 230A may apply the compensation level to each pixel signal of the input image IMI and may output the compensated pixel signal. The compensation level may be the same for all pixel signals (e.g., the same for every pixel signal in a frame) or may be different from one pixel signal to another pixel signal (e.g., may be different depending on a level of each pixel signal in the frame). According to some embodiments, compensation may be provided for all pixel signals of the input image IMI, or compensation may be selectively provided for only pixel signals in a particular range among all pixel signals of the input image IMI. For instance, compensation may be performed only when a signal level is less than or greater than a particular value.

In addition, the compensation level may be different depending on the level of a pixel signal of the input image IMI. Accordingly, the compensation level may be set in a table (referred to as a "compensation level table") having a plurality of input signal level-to-output signal level entries. However, present inventive concepts are not restricted thereto. The compensation level may be calculated using a predetermined algorithm or may be provided by a compensation circuit in some embodiments.

The compensation level table may be implemented as a gamma table. Gamma compensation is usually used to correct a difference in brightness. Gamma values are made into a table in the gamma table.

According to some embodiments, the compensation level is applied to a gamma value and a resulting gamma value is made into a table. The gamma table is stored in the memory 20 or 110 and is used to compensate the input image IMI afterwards.

Figure 5:
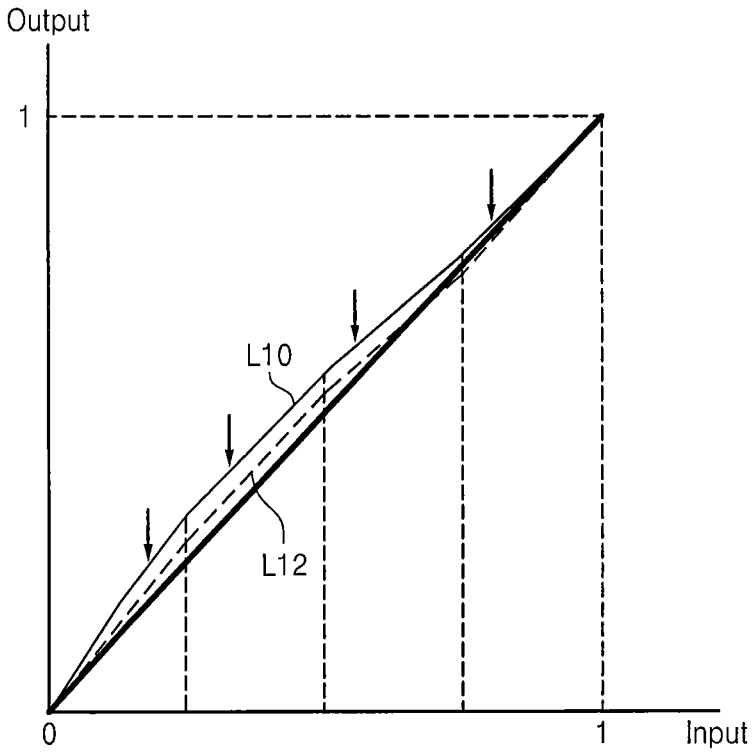
FIG. 5 is a graph showing a gamma curve according to various embodiments of present inventive concepts.

FIG. 5 is a graph showing a gamma curve according to some embodiments of present inventive concepts. A curve L10 is a gamma curve obtained when the compensation level is not used, whereas a curve L12 is a new gamma curve obtained when the compensation level is used. A gamma table corresponding to each of the gamma curves L10 and L12 may be stored. In some embodiments, a gamma compensation circuit providing each gamma curve L10 or L12 may be used.

Although only two gamma curves are illustrated in FIG. 5, more than two gamma tables having a different compensation level may be set in advance according to conditions. The conditions may include at least one of the illumination information LSS, the image characteristic information CHS, and a frame rate. For instance, a plurality of compensation level tables (or gamma tables) may be set in advance according to a plurality of frame rates and may be stored in memory. The image compensation logic 230A may then select a compensation level table or a gamma table corresponding to the final frame rate FRD determined by the frame rate control logic 220A, apply the selected compensation level table or the selected gamma table to each pixel signal of the input image IMI, and output a compensated image IMC.

The compensation level table or gamma table may vary with the illumination information LSS or the image characteristic information CHS as well as the frame rate. When the input image IMI is an RGB format signal, the gamma table may be individually provided for each of Red (R), Green (G) and Blue (B) signals. For instance, an R gamma table for compensation of an R signal in the input image IMI, a G gamma table for compensation of a G signal, and a B gamma table for compensation of a B signal may be set in advance according to a frame rate.

The input image IMI may be compensated in an RGB format in some embodiments. Alternatively, the input image IMI may be compensated in a format, e.g., a YUV format, other than the RGB format. The YUV format may be a YPbPr format in analog transmission or a YCbCr format in digital transmission. The image compensation logic 230A may convert the input image IMI from the RGB format into the YUV format, then compensate the input image IMI in the YUV format, and then convert the compensated input image back into the RGB format.

As described herein, a different compensation level is used depending on a frame rate according to some embodiments of present inventive concepts, so that degradation of picture quality caused by frame rate change can be reduced/prevented. In addition, the SoC 10 changes the brightness and color of an image according to the frame rate change to compensate for luminance and chroma changes that may occur in the display panel 32 (e.g., OLED panel) when a frame rate changes, thereby inhibiting/preventing the picture quality from decreasing.

The image processing apparatus 200A illustrated in FIG. 3 may be implemented within the SoC 10 illustrated in FIG. 2. The image processing apparatus 200A may be implemented in a separate module in the SoC 10, may be implemented in one module, or may be separately implemented in at least two modules.

Figure 6:
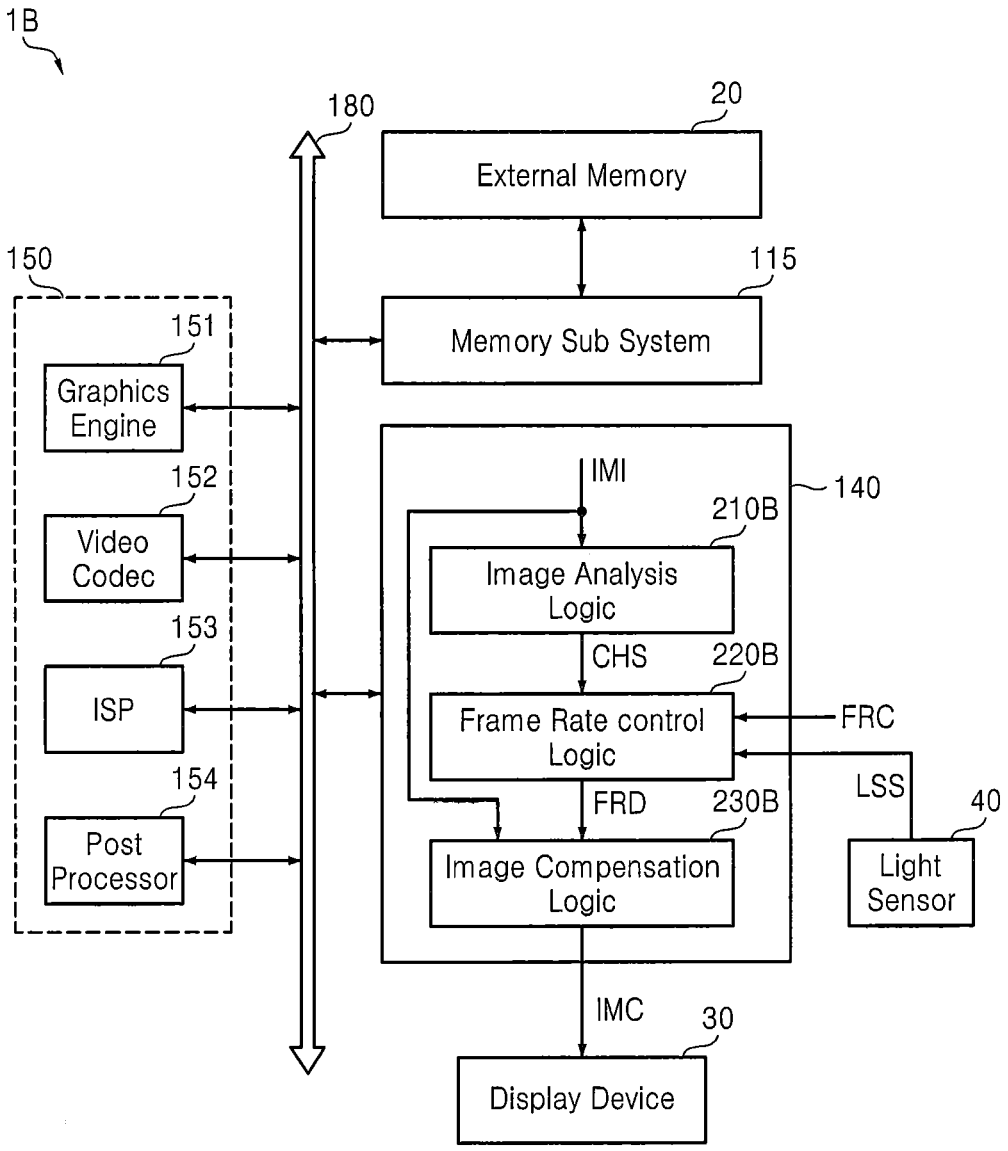
FIG. 6 is a block diagram of an image processing system according to various embodiments of present inventive concepts.

FIG. 6 is a block diagram of an image processing system 1B according to some embodiments of present inventive concepts. Although FIG. 6 illustrates that the image processing system 1B includes only the external memory 20, the display device 30, the light sensor 40, a memory sub system 115, the display controller 140, the multimedia module 150, and the bus 180, the image processing system 1B may also include the CPU 100, the peripherals 120, the connectivity circuit 130, and the power management unit 170 that are included in the image processing system 1A illustrated in FIGS. 1 and 2. In embodiments illustrated in FIG. 6, an image analysis logic 210B, a frame rate control logic 220B, and an image compensation logic 230B are implemented within the display controller 140. The image analysis logic 210B, the frame rate control logic 220B, and the image compensation logic 230B perform the same functions as the image analysis logic 210A, the frame rate control logic 220A, and the image compensation logic 230A illustrated in FIG. 3, and therefore, redundant descriptions may be omitted.

Similarly to the image analysis logic 210A illustrated in FIG. 3, the image analysis logic 210B analyzes the input image IMI and calculates the image characteristic information CHS. The input image IMI is an image output from the multimedia module 150 and it may be stored in the memory sub system 115 or the external memory 20 and may then be input to the display controller 140. The memory sub system 115 may include the internal memory 110 and the memory controller 160 illustrated in FIG. 2.

The multimedia module 150 may include a graphics engine 151, a video codec 152, an image signal processor (ISP) 153, and a post processor 154. The graphics engine 151 may read and execute program instructions related to graphics processing. For instance, the graphics engine 151 may process graphics-related figures/information at high speed. The graphics engine 151 may be implemented as two-dimensional (2D) or three-dimensional (3D) graphics engine. In some embodiments, a graphics processing unit (GPU) or a graphics accelerator may be used instead of, or together with, the graphics engine 151.

The video codec 152 encodes an image or a video signal and decodes an encoded image or an encoded image signal. The ISP 153 may process image data received from an image sensor. For instance, the ISP 153 may perform vibration correction and white balance adjustment on the image data received from the image sensor. In addition, the ISP 153 may also perform color correction such as brightness and contrast adjustment, color balance, quantization, color conversion into a different color space, and so on. The ISP 153 may store (e.g., periodically store) image data that has been subjected to image processing in the memory 115 or 20 through the bus 180.

The post processor 154 performs post processing on an image or a video signal so that the image or video signal is suitable for an output/separate device (e.g., the display device 30). The post processor 154 may enlarge, reduce, or rotate the image so that the image is appropriate to be output to the display device 30. The post processor 154 may store the post-processed image data in the memory 115 or 20 via the bus 180 or may directly output it to the display controller 140 through the bus 180 on the fly (e.g., in real time).

The multimedia module 150 may also include another element, e.g., a scaler. The scaler may adjust the size of an image.

As described herein, the image data processed by the multimedia module 150 may be stored in the memory sub system 115 or the external memory 20 and may then be input to the display controller 140, or it may be directly input to the display controller 140 through the bus 180 without being stored in the memory 115 or 20.

The frame rate control logic 220B determines a frame rate according to the illumination information LSS, the image characteristic information CHS, and the frame rate control signal FRC.

The image compensation logic 230B determines a compensation level of the input image IMI according to the determined frame rate FRD and compensates the input image IMI according to the compensation level. The image compensation logic 230B may also determine the compensation level for the input image IMI according to the illumination information LSS and the image characteristic information CHS. The compensated image IMC generated by the image compensation logic 230B is transmitted to and displayed on the display device 30.

Figure 7:
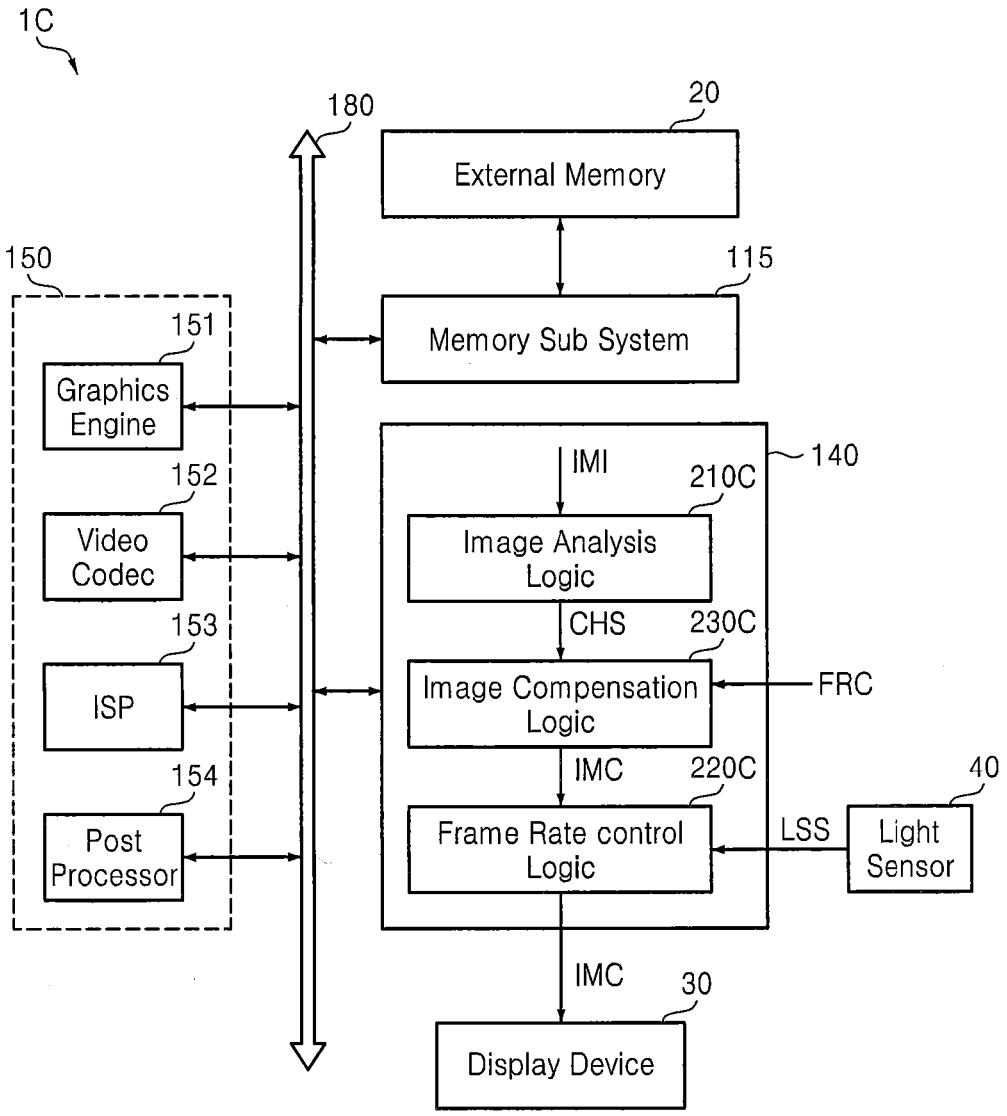
FIG. 7 is a block diagram of an image processing system according to various embodiments of present inventive concepts.

FIG. 7 is a block diagram of an image processing system according to some embodiments of present inventive concepts. An image analysis logic 210C, a frame rate control logic 220C, and an image compensation logic 230C are implemented in the display controller 140. The structure and operations of the image processing system illustrated in FIG. 7 are similar to those of the image processing system 1B illustrated in FIG. 6, and therefore, redundant descriptions may be omitted.

Like the image analysis logic 210B illustrated in FIG. 6, the image analysis logic 210C analyzes the input image IMI and calculates the image characteristic information CHS. The input image IMI may be an image output from the memory sub system 115.

The image compensation logic 230C determines a compensation level of the input image IMI according to the frame rate control signal FRC, compensates the input image IMI according to the compensation level, and outputs the compensated image IMC. The image compensation logic 230C may also determine the compensation level for the input image IMI according to the illumination information LSS and the image characteristic information CHS.

The frame rate control logic 220C determines the final frame rate FRD according to the illumination information LSS, the image characteristic information CHS, and/or the frame rate control signal FRC. The frame rate control logic 220C may output the compensated image IMC from the image compensation logic 230C to the display device 30 according to the final frame rate FRD.

Figure 8:
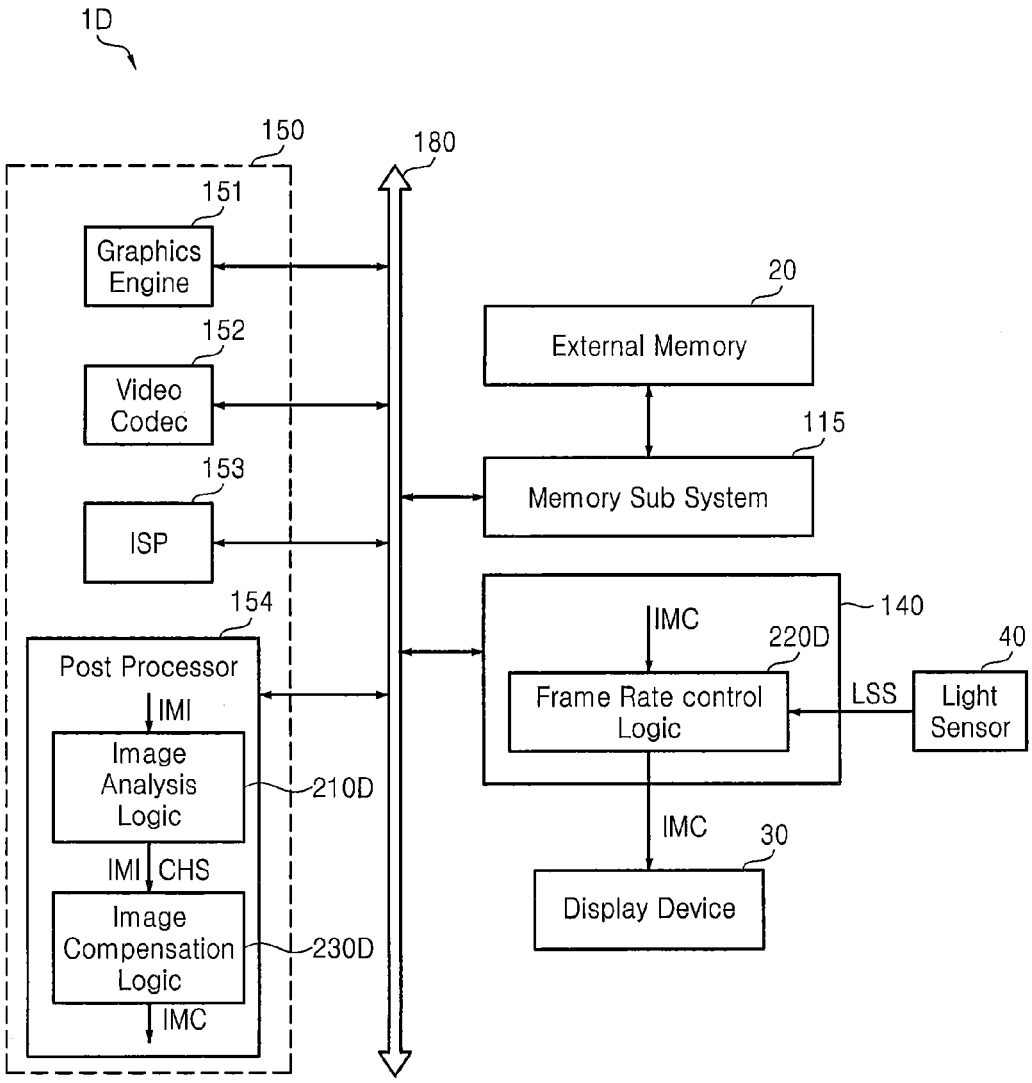
FIG. 8 is a block diagram of an image processing system according to various embodiments of present inventive concepts.

FIG. 8 is a block diagram of an image processing system 1D according to some embodiments of present inventive concepts. In embodiments illustrated in FIG. 8, an image analysis logic 210D and an image compensation logic 230D are implemented within the post processor 154 and a frame rate control logic 220D is implemented within the display controller 140.

The image analysis logic 210D, the frame rate control logic 220D, and the image compensation logic 230D illustrated in FIG. 8 have similar structure and functions to the image analysis logic 210C, the frame rate control logic 220C, and the image compensation logic 230C illustrated in FIG. 7. Thus, redundant descriptions may be omitted.

The image analysis logic 210D analyzes an input image IMI and calculates image characteristic information CHS. According to some embodiments, the image compensation logic 230D may determine a compensation level for the input image IMI according to the frame rate control signal FRC output from the CPU 100, compensate the input image IMI according to the compensation level, and output the compensated image IMC Alternatively, the image compensation logic 230D may determine a compensation level for the input image IMI according to the frame rate FRD determined by the frame rate control logic 220D, compensate the input image IMI according to the determined compensation level, and output the compensated image IMC The compensated image IMC may be stored in the memory 115 or 20 and may then be input to the display controller 140, or may be directly input to the display controller 140 through the bus 180 without being stored in the memory 115 or 20.

The frame rate control logic 220D determines the final frame rate FRD according to the illumination information LSS, the image characteristic information CHS, and/or the frame rate control signal FRC. The display controller 140 may receive and output the compensated image IMC to the display device 30 according to the final frame rate FRD determined by the frame rate control logic 220D.

As illustrated in FIG. 8, if the elements of the image processing device, that is, the image analysis logic 210D, the frame rate control logic 220D, and the image compensation logic 230D are implemented dispersively/separately within at least two modules, then necessary information may be transmitted via the bus 180.

For example, the image characteristic information CHS may be transmitted from the post processor 154 to the display controller 140 via the bus 180, and the final frame rate FRD determined by the frame rate control logic 220D may be transmitted to the post processor 154 via the bus 180.

Figure 9:
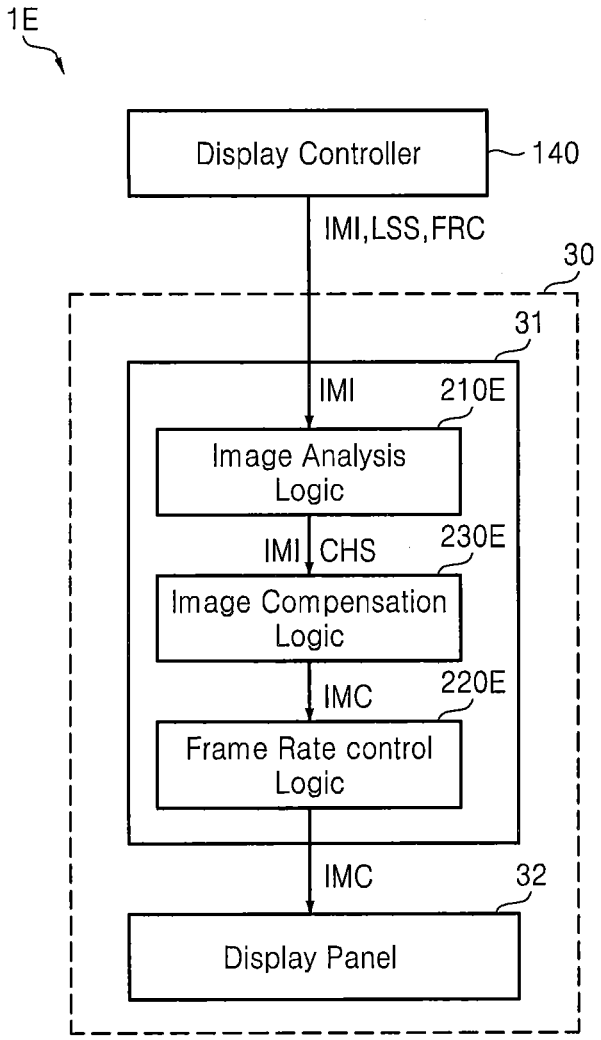
FIG. 9 is a block diagram of an image processing system according to various embodiments of present inventive concepts.

FIG. 9 is a block diagram of an image processing system 1E according to some embodiments of present inventive concepts. An image analysis logic 210E, a frame rate control logic 220E, and an image compensation logic 230E are implemented within the display driver 31 of the display device 30.

The display driver 31 receives an image from the display controller 140 of the SoC 10. The image analysis logic 210E analyzes the input image IMI, i.e., an image received from the SoC 10 and calculates the image characteristic information CHS.

The image compensation logic 230E determines a compensation level for the input image IMI according to the frame rate control signal FRC, and compensates the input image IMI according to the compensation level.

The frame rate control logic 220E determines the final frame rate FRD according to the illumination information LSS, the image characteristic information CHS, and/or the frame rate control signal FRC. The frame rate control logic 220E may output the compensated image IMC to the display panel 32 according to the final frame rate FRD.

In embodiments illustrated in FIG. 9, the illumination information LSS and the frame rate control signal FRC may be transmitted from the SoC 10 to the display driver 31. Alternatively, the light sensor 40 may be connected to the display device 30 and the illumination information LSS may be directly input to the display device 30 from the light sensor 40.

Figure 10:
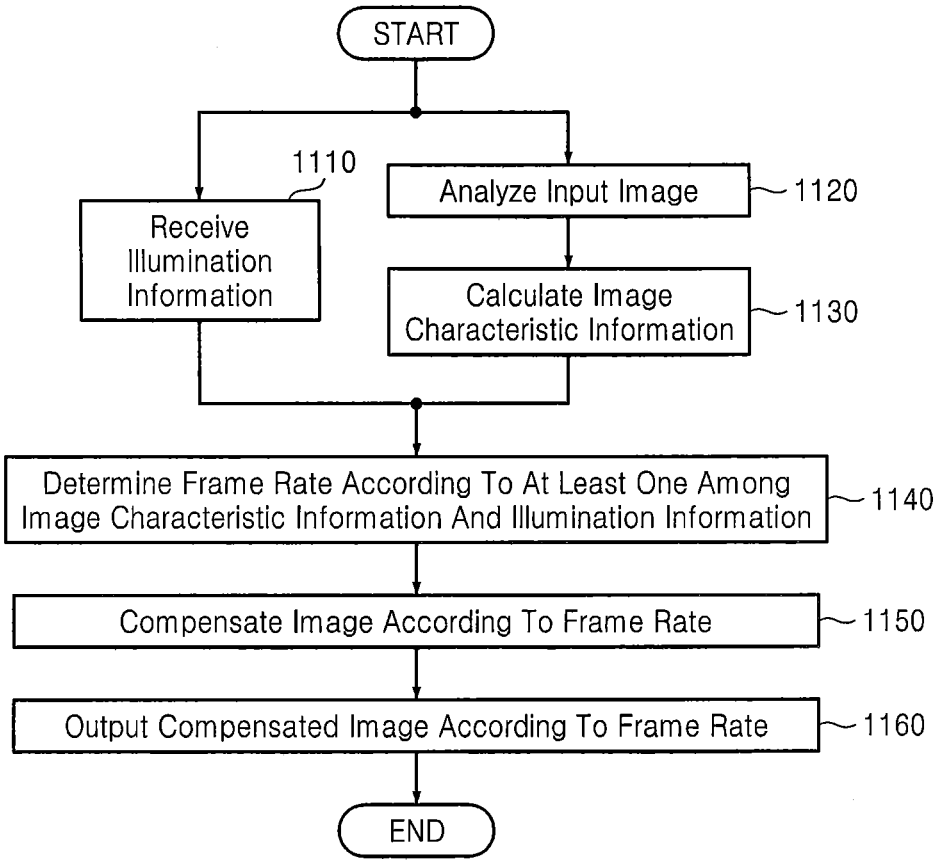
FIG. 10 is a flowchart of an adaptive image compensation method according to various embodiments of present inventive concepts.

FIG. 10 is a flowchart of an adaptive image compensation method according to some embodiments of present inventive concepts. The adaptive image compensation method may be performed by the image processing apparatus 200A or one of the systems 1A through 1E including the image processing apparatus 200A.

Referring to FIG. 10, the illumination information LSS is received from the light sensor 40 in operation/Block 1110. When the light sensor 40 is enabled, the light sensor 40 may detect (e.g., periodically detect) illumination and the SoC 10 may periodically or non-periodically read the illumination information LSS from the light sensor 40.

Meanwhile, the image processing apparatus 200A receives (e.g., periodically receives) the input image IMI, analyzes the input image IMI, and calculates the image characteristic information CHS in operations/Blocks 1120 and 1130. For instance, the image processing apparatus 200A may read (e.g., periodically read) frame data from the memory 110 or 20 and analyze the frame data in operation/Block 1120 and may calculate the image characteristic information CHS for each frame in operation/Block 1130. In some embodiments, the image processing apparatus 200A may obtain a luminance histogram of the input image IMI in units of frames and may calculate an average luminance of the input image IMI from the luminance histogram in operations/Blocks 1120 and 1130. However, the average luminance is just one example of the image characteristic information CHS and a variance of the luminance, an average chroma, or a variance of the chroma may be calculated as the image characteristic information CHS.

Histogram data may be calculated using previous frame data as well as current frame data. The analysis of the input image IMI and the calculation of the image characteristic information CHS may be selectively or independently enabled or disabled, so that power consumption is reduced.

The image processing apparatus 200A determines a frame rate according to at least one among the image characteristic information CHS and the illumination information LSS in operation/Block 1140.

Figure 11:
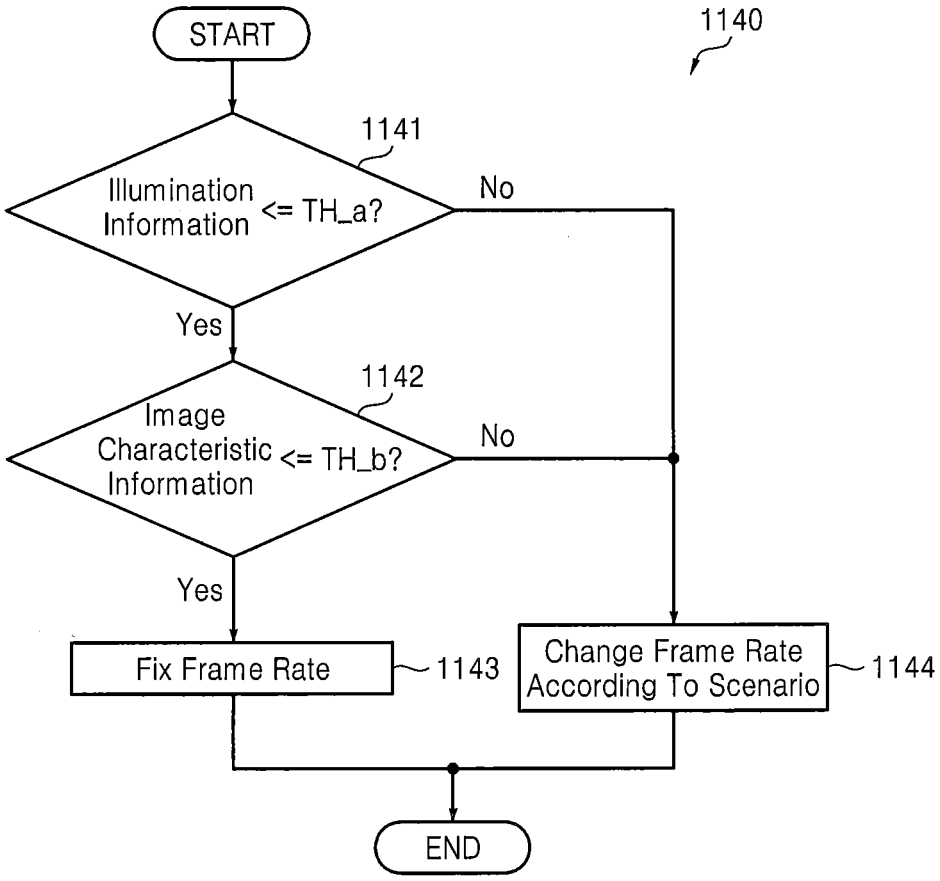
FIG. 11 is a flowchart of a method of determining a frame rate according to various embodiments of present inventive concepts.

FIG. 11 is a flowchart of determining the frame rate in operation/Block 1140 according to some embodiments of present inventive concepts. Referring to FIG. 11, the image processing apparatus 200A may compare the illumination information LSS with the illumination threshold Th_a in operation/Block 1141, compare the image characteristic information CHS with the characteristic threshold Th_b in operation/Block 1142, and determine to fix (e.g., hold, preserve, maintain) a frame rate when the illumination information LSS is equal to or less than the illumination threshold Th_a and the image characteristic information CHS is equal to or less than the characteristic threshold Th_b (case A20) in operation/Block 1143.

However, when the illumination information LSS is greater than the illumination threshold Th_a or the image characteristic information CHS is greater than the characteristic threshold b in operations/Blocks 1141 and 1142, the image processing apparatus 200A may change the frame rate in operation/Block 1144. In operation/Block 1144, the image processing apparatus 200A may change the frame rate according to the control of the CPU 100, a predetermined scenario, or a type of signal to be displayed.

When the frame rate is determined in operation/Block 1140, the image is compensated according to (e.g., responsive to, based on, using) the frame rate in operation/Block 1150 and the compensated image is output and displayed according to the frame rate in operation/Block 1160.

Figure 12:
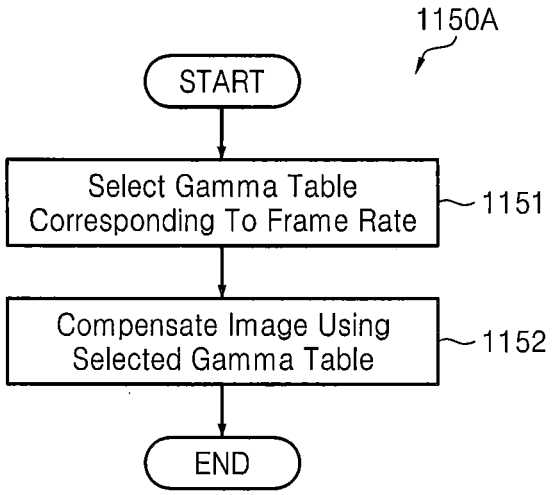
FIG. 12 is a flowchart of a method of compensating an image according to various embodiments of present inventive concepts.

FIG. 12 is a flowchart of an example 1150A of compensating the image in operation/Block 1150. Referring to FIG. 12, the image processing apparatus 200A may select a compensation level table corresponding to the frame rate from among a plurality of compensation level tables (e.g., gamma tables) in operation/Block 1151 and may compensate the image using the selected compensation level table in operation/Block 1152. At this time, the compensation level table may be independently provided for each of R, G and B signals. For instance, an R gamma table for compensation of an R signal in the input image IMI, a G gamma table for compensation of a G signal, and a B gamma table for compensation of a B signal may be set in advance (e.g., predetermined) according to a frame rate.

Each of the plurality of gamma tables may include a plurality of input signal level value-to-output signal level value entries. Moreover, each of a plurality of input signal level values may include a luminance signal of the input image IMI or a chroma signal of the input image IMI, and each of a plurality of output signal level values may include a luminance signal of the compensated image IMC or a chroma signal of the compensated image IMC.

Figure 13:
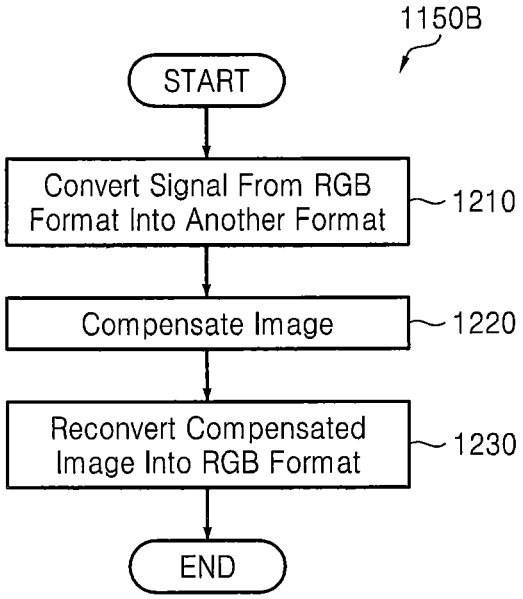
FIG. 13 is a flowchart of a method of compensating an image according to various embodiments of present inventive concepts.

FIG. 13 is a flowchart of another example 1150B of compensating the image in/Block operation 1150. Referring to FIG. 13, when the input image IMI has the RGB format, the image processing apparatus 200A may convert the input image IMI into another format (e.g., the YUV format) in operation/Block 1210, then compensate the input image IMI in the YUV format in operation/Block 1220, and then reconvert the input image IMI into the RGB format in operation/Block 1230.

As described herein, according to some embodiments of present inventive concepts, an image is compensated according to the change of a frame rate, so that a decrease in picture quality is inhibited/prevented. In addition, the image is adaptively compensated according to an input image, so that the picture quality is increased. Consequently, the frame rate is changed according to content (e.g., a type of data) displayed on a display device, so that power consumption is reduced and the deterioration of the picture quality caused by the change of the frame rate is inhibited/prevented.

The above-disclosed subject matter is to be considered illustrative, and not restrictive, and the appended claims are intended to cover all such modifications, enhancements, and other embodiments, which fall within the true spirit and scope. Thus, to the maximum extent allowed by law, the scope is to be determined by the broadest permissible interpretation of the following claims and their equivalents, and shall not be restricted or limited by the foregoing detailed description.

What is claimed is:

1. A method of adaptively compensating an input image to be displayed on a display device, the method comprising:

receiving illumination information sensed by a light sensor;

calculating image characteristic information by analyzing the input image;

determining a frame rate of the display device according to at least one among the illumination information, the image characteristic information, and a frame rate control signal;

after determining the frame rate of the display device, determining a compensation level for the input image according to the frame rate of the display device; and compensating the input image using the compensation level, wherein the determining the compensation level comprises selecting a gamma table corresponding to the frame rate of the display device from among a plurality of gamma tables that are set in advance according to different frame rates.

2. The method of claim 1, further comprising outputting a compensated image according to the frame rate of the display device.

3. The method of claim 1, wherein determining the frame rate of the display device comprises:

comparing the illumination information with an illumination threshold;

comparing the image characteristic information with a characteristic threshold; and holding or changing the frame rate of the display device, responsive to a first result of comparing the illumination information with the illumination threshold and/or responsive to a second result of comparing the image characteristic information with the characteristic threshold.

4. The method of claim 1, wherein compensating the input image using the compensation level comprises:

applying the compensation level to each of a plurality of pixel signals of the input image.

5. The method of claim 4, wherein each of the plurality of pixel signals comprises at least one of a luminance signal and a chroma signal.

6. The method of claim 4, wherein each of the plurality of gamma tables comprises a plurality of input signal level value-to-output signal level value entries, wherein each of a plurality of input signal level values comprises a luminance signal of the input image or a chroma signal of the input image, and wherein each of a plurality of output signal level values comprises a luminance signal of the compensated image or a chroma signal of the compensated image.

7. The method of claim 4, wherein compensating the input image further comprises:

converting the input image from an RGB format into a YPbPr or YCbCr format;

compensating the input image after converting the input image from the RGB format into the YPbPr or YCbCr format; and converting the input image back into the RGB format after compensating the input image.

8. The method of claim 4, wherein compensating the input image further comprises one of:

compensating all of the plurality of pixel signals of the input image; and selectively compensating only ones of the plurality of pixel signals of the input image that are in a particular range.

9. The method of claim 1, further comprising selectively enabling the light sensor.

10. The method of claim 1, wherein the frame rate control signal comprises a signal that selectively changes the frame rate of the display device according to a type of the input image.

11. An adaptive image compensation apparatus comprising:

an image analysis logic configured to analyze an input image and calculate image characteristic information;

a frame rate control logic configured to determine a frame rate of a display device according to at least one of illumination information and the image characteristic information; and an image compensation logic configured to determine a compensation level for the input image according to the frame rate of the display device and compensate the input image using the compensation level, wherein the image compensation logic is configured to determine the compensation level based on selection of a gamma table corresponding to the frame rate of the display device from among a plurality of gamma tables that are set in advance according to different frame rates.

12. The adaptive image compensation apparatus of claim 11, wherein the frame rate control logic is configured to determine whether to change the frame rate of the display device according to the illumination information and the image characteristic information.

13. The adaptive image compensation apparatus of claim 11, wherein the frame rate control logic is configured to:

compare the illumination information with an illumination threshold;

compare the image characteristic information with a characteristic threshold; and hold or change the frame rate of the display device, responsive to a first result of comparing the illumination information with the illumination threshold and/or responsive to a second result of comparing the image characteristic information with the characteristic threshold.

14. The adaptive image compensation apparatus of claim 11, wherein the image compensation logic is configured to apply the compensation level to each of a plurality of pixel signals of the input image.

15. The adaptive image compensation apparatus of claim 11, wherein the compensation level is uniform for every pixel signal in a frame or varies depending on a level of each of a plurality of pixel signals in the frame.

16. A method of operating an image processing apparatus, the method comprising:

analyzing an image that is input to the image processing apparatus;

determining a change of a frame rate of a display device for displaying images, responsive to analyzing the image;

determining, based on the change of the frame rate of the display device, a quality compensation level for the image that is input to the image processing apparatus, after determining the change of the frame rate of the display device; and compensating the input image using the quality compensation level, wherein the determining the quality compensation level comprises selecting a gamma table corresponding to the frame rate of the display device from among a plurality of gamma tables that are set in advance according to different frame rates.

17. The method of claim 16, wherein determining the change of the frame rate of the display device comprises:

changing the frame rate of the display device responsive to an image type of the image that is input to the image processing apparatus, and wherein determining the quality compensation level for the image comprises:

compensating the image to the quality compensation level, responsive to determining the change of the frame rate of the display device.

18. The method of claim 17, wherein changing the frame rate of the display device responsive to the image type comprises:

changing the frame rate of the display device responsive to determining that the image type comprises a still image, wherein the change of the frame rate of the display device comprises a decrease in the frame rate of the display device, and wherein compensating the image comprises:

compensating the image to the quality compensation level, responsive to the decrease in the frame rate of the display device.

19. The method of claim 16, wherein analyzing the image comprises calculating image characteristic information for the image, and wherein the method further comprises:

receiving illumination information from a light sensor; and performing the change of the frame rate, responsive to determining that the illumination information exceeds an illumination threshold and/or that the image characteristic information exceeds a characteristic threshold.

* * * * *